United States Patent [19]

Gerber et al.

[11] 4,102,758

[45] Jul. 25, 1978

[54] METHOD OF ELECTROLYTICALLY FORMING SILVER HALIDE GRAINS UTILIZING A NOVEL CATHODE

[75] Inventors: Arthur M. Gerber, Boston; Vivian K. Walworth, Concord, both of Mass.

[73] Assignee: Polaroid Corporation, Cambridge, Mass.

[21] Appl. No.: 775,044

[22] Filed: Mar. 7, 1977

[51] Int. Cl.[2] ..... C25B 1/24; C25B 11/04; C25B 11/08

[52] U.S. Cl. ..... 204/94; 96/94 R; 204/294

[58] Field of Search ..... 204/94, 290 R, 291, 204/294; 96/94, 94 R, 94 BF

[56] References Cited

U.S. PATENT DOCUMENTS

| | | | |
|---|---|---|---|
| 466,720 | 1/1892 | Currie | 204/94 R |
| 1,602,595 | 10/1926 | Sheppard et al. | 204/94 R |
| 1,801,784 | 4/1931 | Schwarz | 204/180 P |
| 3,135,674 | 6/1964 | Ruetschi | 204/291 |
| 3,397,087 | 8/1968 | Yoshizawa et al. | 204/294 |
| 3,458,421 | 7/1969 | Dahms | 204/195 F |

FOREIGN PATENT DOCUMENTS

| | | | |
|---|---|---|---|
| 1,079,452 | 4/1960 | Fed. Rep. of Germany | 204/94 |
| 643,223 | 9/1950 | United Kingdom | 204/94 |

*Primary Examiner*—T. M. Tufariello
*Attorney, Agent, or Firm*—Philip G. Kiely

[57] ABSTRACT

An electrolytic cell for generating silver ions and halide ions for the formation of photosensitive silver halide grains wherein the cathode comprises elemental halogen and electrically conductive carbon.

10 Claims, No Drawings

METHOD OF ELECTROLYTICALLY FORMING SILVER HALIDE GRAINS UTILIZING A NOVEL CATHODE

BACKGROUND OF THE INVENTION

Copending application Ser. No. 672,647, filed Apr. 1, 1976 now U.S. Pat. No. 4,060,419, issued Nov. 29, 1977 is directed to a method for forming photosensitive silver halide emulsions by electrolysis which comprises the steps of electrolytically generating silver ions and soluble negative ions, preferably halide, in a solution of an electrolyte, reacting the silver ions and negative ions remote from the electrode, to form grains, growing the grains to the desired size, disposing the grains in a polymeric binder such as gelatin, and coating the binder-grain mix. Conventional sensitization and addenda may be employed as desired.

The method of application Ser. No. 672,647 now U.S. Pat. No. 4,060,419 obviates the critical and tedious washing requirements of the prior art. In a preferred embodiment, the electrolytic generation of the ions is carried out in the presence of a polymeric binder material; however, the binder is not critical and the reaction can be carried out without any binder in the electrolyte solution.

Application Ser. No. 672,647 now U.S. Pat. No. 4,060,419 is incorporated herein in its entirety.

The present invention is directed to a novel electrolytic cell for use in the above-mentioned method for forming silver halide grains.

SUMMARY OF THE INVENTION

The present invention is directed to an electrolytic cell for forming silver halide grains which comprises a housing, a silver anode, a halide generating cathode and a solution of electrolyte wherein said cathode comprises elemental halogen absorbed into electrically conductive carbon. A preferred form of carbon is graphitic carbon.

DETAILED DESCRIPTION OF THE INVENTION

Copending application Ser. No. 672,647 discloses a number of materials suitable for employment as the cathode to generate the halide ion. For example, the cathode may comprise an insoluble halide salt or elemental halogen absorbed onto an inert carrier contained in a porous container. Disadvantages exist with most of the described systems, however, for example, a limited surface active area. For example, with a silver halide cathode the maximum amount of halide that could be produced in the cell and available for reaction is limited to the amount of halide present in the silver halide cathode. With a silver bromide cathode in the form of a relatively thin layer, this could present a limitation to quantity silver halide production. In addition, cell operation with such a cathode often results in the formation of fine, black, elemental silver as a by-product which, if not properly contained, could contaminate the emulsion.

Elemental halogens would avoid many of the above-mentioned problems, but because of their unpleasant, corrosive and often hazardous properties as well as the difficulties in handling they present additional problems.

A novel cathode for use in electrolyic cells employing elemental halogen has now been found.

The novel cell of the present invention employs, as a cathode, elemental halogen absorbed into electrically conductive carbon, preferably in the form of carbon black or graphite. Retention by carbon thus minimizes the corrosive effects, and particularly in the case of chlorine and bromine, the volatile property of the halogens, while at the same time making them readily available in the quantities desired during cell operation.

The use of a halogen-carbon black powder cathode preferably includes a physical barrier in the cell to retain the carbon black powder and avoid contamination of the silver halide grains with carbon black particles.

Preferably, the carbon is employed in the form of graphitic carbon or pressed carbon black plates or rods. Graphite or pressed carbon black in these forms are particularly suitable since no physical barrier is required; and graphite, in plate or rod, as thin as one-quarter of an inch is mechanically strong, self-supporting and can be fabricated to the size and shape desired. In addition, graphite possesses sufficiently high conductivity to permit the direct electrical contact.

There are references in the literature to the effect that definite lamellar compounds are formed by the addition of halogen to the graphite. (Ubbelohde, A. R. and Lewis, F. A., Graphite and Its Crystal Compounds, Oxford (1960), pp 118–130 and Kagan, H. B., Chemtech 6,510 (1976).) As used herein, the expressions "having halogen absorbed thereon" or "absorbed into" are intended to include both the physical and/or chemical retention of halogen by the carbon substrate.

In order to illustrate the retentive properties of a graphite plate, liquid bromine was added to a dry graphite plate (4cm × 4cm × 0.7cm) about one minute allowed for absorption, then 25 ml. of water was added. After 2 hours the plate was removed and the liquid titrated with silver nitrate. The amount of silver nitrate needed to reach the end-point, as detected with a silver sulfide specific ion electrode, was compared with the amount of bromine originally added. The data indicated that about 85% of the bromine applied was retained. It has also been found that about 90% bromine retention can be achieved by a heat treatment of the graphite in an oven; for example, 2 hours at 700° C, before bromine addition.

As a comparison, the above procedure was repeated except that an equimolar amount of potassium bromide (KBr in water) was substituted for the liquid bromine. It was found that 65% of the potassium bromide was eluted.

The halogen may be absorbed into the carbon from liquid or vapor. In the case of iodine, the carbon can be exposed to sublimating iodine crystals.

The novel cathode of the present invention can be used with an anode of substantially any form capable of generating silver ions including the anodes described in copending application Ser. No. 672,647. In a particularly preferred embodiment, the anode comprises the silver needle anode disclosed and claimed in copending application Ser. No. 775,045, filed concurrently herewith.

Any suitable electrolyte which is not detrimental to the photographic process and which does not require a removal step may be employed. Electrolytes may also be selected for other utility in addition to electrical conductance. Such electrolytes may also function as pH buffers, pAg buffers, redox buffers, developing agents, Ostwald ripening agents, quaternary salts, dispersants and surfactants. Chemical and spectral sensitizing agents may also be present in the electrolyte during electrolysis to provide sensitization of the grains as they are formed.

It has also been found that conductive polymers such as those disclosed and claimed in copending application Ser. No. 775,046; can be employed as the electrolyte, thus providing both the conductivity required and at least a portion of the binder material. A particularly useful conductive polymer comprises poly-2-acrylamido-2-methylpropane sulfonic acid.

Suitable binders, singly or in combinations may be employed with the anodes and cathodes in the cells of the present invention. Both synthetic and natural polymers are contemplated for use in the present invention. The binders may be conductive or nonconductive; however, if they are nonconductive, the ratio of conductive to nonconductive material must be sufficient to permit cell operation.

The following non-limiting examples illustrate the novel cells of the present invention.

EXAMPLE 1

A cell was constructed comprised of a flat Teflon tank assembly 6 inches × 6 inches × ½ inches; an anode comprising a paste of 300 g. of silver needles in 100 ml. of poly-2-acrylamido-2-methylpropane sulfonic acid in water (2.5% solids) with a platinum wire contact; a parchment separator; and a cathode comprising 65 g. of carbon black, 5 ml. of elemental bromine and 100 ml. of poly-2-acrylamido-2-methylpropane sulfonic acid in water (2.5% solids) with a platinum screen contact; and, as an electrolyte, 350 ml. of poly-2-acrylamido-2-methylpropane sulfonic acid in water (5.5% solids). The cell was operated for one hour with a current efficiency (amps/liter) of 1.1. Current efficiency, or current flow per unit volume (amps/liter), determines the time the cell must operate to reach a usefully coatable silver concentration. A vibrating stirrer was employed during the cell operation. Turbidity increased with time indicating that grains were forming.

EXAMPLE 2

A cell was constructed composed of a circular, 6 inch diameter container, fitted with a paddle stirrer; an anode comprising silver needles (100 g.) adhesively bonded with a pyroxylin based cement sold under the trade name DUCO by E. I. duPont de Nemours & Co., Wilmington, Delaware, to a ⅛ inch thick graphite disc 5¾ inch in diameter; and, as an electrolyte 400 ml. of poly-2-acrylamido-2-methylpropane sulfonic acid in water (5.5% solids). The cell was operated for 4 hours with a current efficiency of 1.3. Turbidity increased as grains were formed and analysis showed the emulsion to contain 1.2% silver.

EXAMPLE 3

A cell was constructed composed of a 600 ml. beaker, an anode comprising a circular sheet of silver; a cathode comprising a sintered glass thimble containing 30 g. of carbon black, 10 ml. of elemental bromine and 200 ml. of poly-2-acrylamido-2-methylpropane sulfonic acid in water (25% solids), and, as an electrolyte 350 ml. of poly-2-acrylamido-2-methylpropane sulfonic acid in water (5.5% solids). The cell was operated for 3 hours with a current efficiency of 1.0. Turbidity increased as grains were formed and analysis showed the emulsion to contain 1.4% silver.

EXAMPLE 4

A cell was constructed composed of the Teflon tank assembly of Example 1, an anode comprising 66 g. of silver needles adhesively secured to a polymethyl methacrylate support with DUCO cement; a cathode comprising 10 g. deacetylated chitin; 5 ml. of elemental bromine, 10 g. carbon black and 125 ml. of poly-2-acrylamido-2-methylpropane sulfonic acid in water (5.5% solids) and, as an electrolyte, 175 ml. of poly-2-acrylamido-2-methylpropane sulfonic acid in water (5.5% solids). The cell was run for 2 hours with a current efficiency of 4.0. Turbidity increased as grains were formed and analysis showed the emulsion to contain 1.6% silver.

With regard to the use of chemical sensitizing agents suitable for employment in the present invention, mention may be made of U.S. Pat. Nos. 1,574,944; 1,623,499; 2,410,689; 2,597,856; 2,597,915; 2,487,850; 2,518,698; 2,521,926; and the like, as well as Neblette, C. B., *Photography, Its Materials and Processes,* 6th Ed., 1962.

Spectral sensitization of the silver halide grains may be accomplished by contact of the grain composition with an effective concentration of the selected spectral sensitizing dyes dissolved in an appropriate dispersing solvent such as methanol, ethanol, acetone, water and the like; all according to the traditional procedures of the art, as described in Hamer, F. M., *The Cyanine Dyes And Related Compounds,* as well as the above-mentioned disposition of the sensitizers in the electrolyte solution prior to or during grain formation.

Reduction sensitization of the grains prior to or subsequent to the addition of the binder may also be accomplished employing conventional materials known to the art, such as stannous chloride.

Sensitizers of the solid semiconductor type, such as lead oxide, may also be employed.

Additional optional additives, such as coating aids, hardeners, viscosity-increasing agents, stabilizers, preservatives, and the like also may be incorporated in the emulsion formulation, according to the conventional procedures known in the photographic emulsion manufacturing art.

What is claimed is:

1. In a method which comprises the electrolytic generation of silver ions and halide ions employing a silver anode and a cathode which is a source of halide ions and precipitation in the electrolyte of the ion pairs remote from the electrodes to provide photosensitive silver halide grains in the substantial absence of counterions in said electrolyte;

the improvement wherein said cathode comprises elemental halogen and electrically conductive carbon.

2. The method as defined in claim 1 wherein said carbon is in the form of carbon black.

3. The method as defined in claim 1 wherein said carbon is in the form of graphitic carbon.

4. The method as defined in claim 3 wherein said carbon is in the form of a graphite plate.

5. The method as defined in claim 3 wherein said carbon is in the form of a graphite rod.

6. The method as defined in claim 1 wherein said halogen is bromine.

7. The method as defined in claim 1 wherein said halogen is chlorine.

8. The method as defined in claim 1 wherein said halogen is iodine.

9. The method as defined in claim 1 wherein said silver anode comprises silver needles.

10. The method as defined in claim 1 wherein said electrolite comprises a conductive polymer.

* * * * *